US005357660A

United States Patent [19]

Smith

[11] Patent Number: 5,357,660

[45] Date of Patent: Oct. 25, 1994

[54] SOCK PAIRING APPARATUS

[76] Inventor: Richard E. Smith, 144 Ovid St., Seneca Falls, N.Y. 13148

[21] Appl. No.: 45,882

[22] Filed: Apr. 15, 1993

[51] Int. Cl.[5] ..... A41F 1/00; A44B 17/00

[52] U.S. Cl. ..... 24/662; 24/90 C; 24/DIG. 29; 2/239; 40/633

[58] Field of Search ..... 24/662, 324, 461, 302, 24/687, 590, 90 C, 90 A; 40/633, 159; 2/239

[56] References Cited

U.S. PATENT DOCUMENTS

| | | | |
|---|---|---|---|
| 811,406 | 1/1906 | Keil | 24/90 C |
| 1,118,555 | 11/1914 | Kanter | 24/90 C |
| 3,041,743 | 7/1962 | Monsma | 24/DIG. 29 |
| 3,384,938 | 5/1968 | O'Connor | 24/461 |
| 3,538,557 | 11/1970 | Hirose | 24/662 |
| 4,058,853 | 11/1977 | Boxer et al. | 2/239 |
| 4,318,234 | 3/1982 | Charles et al. | 40/633 |
| 4,344,240 | 8/1982 | Schiller | 24/90 A |
| 4,965,902 | 10/1990 | Mazzoli . | |
| 5,038,413 | 8/1991 | Ursino | 24/DIG. 29 |

*Primary Examiner*—Victor N. Sakran

[57] ABSTRACT

A new and improved sock pairing apparatus includes a pair of similar sock clamp assemblies which include similar indicia. Each respective sock clamp assembly is used with one sock of a pair of socks. Each respective sock clamp assembly includes a pair of first and second clamping elements for clamping the respective sock clamp assembly onto a respective sock of the pair of socks. Each respective first clamping element is placed on a respective sock against a first side of a sock wall. Each respective second clamping element is placed against a second side of the respective sock wall in registration with the respective first clamping element and clamped thereto. In this way, a portion of the sock wall is permanently clamped between the respective first clamping element and the respective second clamping element. The first clamping element may be a rigid member that includes a locking assembly for locking the second clamping element thereto. In this case, the second clamping element is a flexible, resilient member. In another embodiment, the first clamping element and the second clamping element are complementary; and the first clamping element includes flexible, resilient, circumferential C-shaped tabs connected to a circumferential edge of the first clamping element. The second clamping element is a rigid member which includes a V-shaped circumferential edge.

9 Claims, 3 Drawing Sheets

SOCK PAIRING APPARATUS

BACKGROUND OF THE INVENTION

1. Field of the Invention

The present invention relates generally to apparatus for pairing socks, and more particularly, to an apparatus for permanently permitting pairs of socks to be pick out and matched when the socks are intermingled with other socks.

2. Description of the Prior Art

When multiple pairs of socks are laundered together, it is often a difficult task for a person to correctly sort the intermingled socks into proper pairs. Often socks that are close in color may actually be improperly matched, but they appear to be properly matched in artificial interior light. However, when the socks are being worn by the person, and they are viewed in natural light, the improper matching may be visible. Improperly matched socks are often a cause of embarrassment, and it would be desirable if an apparatus were devised that assisted in proper matching of socks no matter what form of light the intermingled socks are viewed in.

There are prior art patents which address the problem of mismatched socks. A number of representative prior art solutions to the problem are found in the following U.S. Pat. Nos.: 3,492,746; 4,734,938; 4,958,388; and 4,965,902. In one approach, identifying threads are sewn into the respective socks of a pair. In another approach, individual socks are written upon by an indelible ink with the name of the color of the sock. In yet another approach, socks are provided with sewn in identifying stripes. In still another method, pairs of socks are joined together by an adhesive material prior to laundering, and the joining material is taken off after laundering.

There are also other approaches to identifying items of clothing in general, but they are not directed specifically to matching pairs of socks. Some such approaches are disclosed in the following U.S. Pat. Nos.: 4,576,668; and 4,837,960. In one approach, a labeled tag is bonded to a garment my a heat-activatable tag and a tool for applying heat of activation to the tag. In another approach, special sockets are sewn into a shoe, and identifying elements are snap-fitted into the sewn in sockets.

A study of the prior art methods of identifying clothing present a number of disadvantages in identifying individual pairs of socks in a pile of laundered, intermingled socks. For example, use of identifying threads requires the socks to be specially made. Such a case would be expensive and not suitable for socks that have not been made that way in the factory. In this respect, it would be desirable if a device were provided that enabled identification of pairs of socks from an intermingled pile which does not use sewn in threads.

The use of heat-activated labels is undesirable in several respects. First there is the danger of overheating and burning of the label or clothes. Then there is the danger of the operator being burned. In this respect, it would be desirable if a device were provided that enabled identification of pairs of socks from an intermingled pile without using heat activated labels.

The use of sewn on labels for garments has the disadvantage of the time and labor of sewing. Moreover, sewing is a special skill that must be learned and practiced. Many people never learn to sew or sew well. Others have learned to sew but have forgotten how to do so because of lack of practice. In this respect, it would be desirable if a device were provided that enabled identification of pairs of socks from an intermingled pile without the need to know the skills of sewing.

The use of special means for joining pairs of socks together for laundering and removing the special means when the laundering has been completely and the socks are matched is very wasteful of the time of the person doing the laundry. If a person does laundry fifty-two times a year, then the process of joining the socks together for laundering must be repeated fifty-two times in the year. Moreover, the joining means must be periodically replenished in that some of it is consumed each time the laundry is done. In this respect, it would be desirable if a device were provided that enabled identification of pairs of socks from an intermingled pile which did not require the use of special materials for laundering that are removed after laundering and replaced for the next laundering.

The use of indelible laundry marking ink also has its disadvantages. Laundry inks are generally dark colored. Such dark inks may be fine for marking light colored socks. However, it would be very difficult to see dark laundry ink indicia on darkly colored socks, such as black socks. Moreover, the use of laundry pens can be very tedious. Furthermore, if the socks are made from delicate fabrics, the sharp point of pen can possibly damage the material. In this respect, it would be desirable if a device were provided that enabled identification of pairs of socks from an intermingled pile without the disadvantages of using a laundry marking pen.

Thus, while the foregoing body of prior art indicates it to be well known to use a number of techniques to match pairs of socks from an intermingled pile, the prior art described above does not teach or suggest a sock pairing apparatus enables identification of pairs of socks from an intermingled pile which has the following combination of desirable features: (1) assists in proper matching of socks no matter what form of light the intermingled socks are viewed in; (2) does not use sewn-in threads; (3) does not use heat activated labels; (4) does not require the knowledge of sewing skills; (5) does not require the use of special materials for laundering that are removed after laundering and that are replaced for the next laundering; and (6) does not use a laundry marking pen. The foregoing desired characteristics are provided by the unique sock pairing apparatus of the present invention as will be made apparent from the following description thereof. Other advantages of the present invention over the prior art also will be rendered evident.

SUMMARY OF THE INVENTION

To achieve the foregoing and other advantages, the present invention, briefly described, provides a new and improved sock pairing apparatus which includes a pair of similar sock clamp assemblies which include similar indicia. Each respective sock clamp assembly is used with one sock of a pair of socks. Each respective sock clamp assembly includes a pair of first and second clamping elements for clamping the respective sock clamp assembly onto a respective sock of the pair of socks. Each respective first clamping element is placed on a respective sock against a first side of a sock wall. Each respective second clamping element is placed against a second side of the respective sock wall in registration with the respective first clamping element and clamped thereto. In this way, a portion of the sock wall is clamped between the respective first clamping element and the respective second clamping element. Each respective similar sock clamp assembly is attached to a respective sock in the pair of socks and both socks in the pair of socks bear similar indicia.

The first clamping element and the second clamping element are complementary. The first clamping element may be a rigid member that includes a locking assembly for locking the second clamping element thereto. In this case, the second clamping element is a flexible, resilient member that is capable of being deformed into two deformation states. A first deformation state of the second clamping element is obtained upon moving the clamped portion of the sock wall passed the locking assembly and upon moving past the locking assembly as the second clamping element is being installed in the first clamping element.

A second deformation state of the second clamping element is obtained after the second clamping element has moved past the locking assembly and is locked into the first clamping element by the locking assembly. Whereby the sock clamp assembly is clamped onto the portion of the sock wall that is clamped between the first clamping element and the second clamping element.

The locking assembly on the first clamping element may include a circumferential, C-shaped flange. The second clamping element may include a flexible, resilient disk element which includes a circumferential edge which pushes a portion of the sock wall into the circumferential, C-shaped flange and fits into the circumferential, C-shaped flange when a sock clamp assembly is installed on the sock.

The locking assembly on the first clamping element may include a centrally located, C-shaped flange. The second clamping element may include a flexible, resilient, snap-on disk element which includes a complementary, C-shaped well that is complementary to the centrally located, C-shaped flange. The walls of the complementary, C-shaped well push a portion of the sock wall onto the centrally located, C-shaped flange and fits onto the centrally located, C-shaped flange when a sock clamp assembly is installed on the sock.

In another embodiment, the first clamping element and the second clamping element are complementary; and the first clamping element includes a locking assembly for locking the second clamping element thereto. The locking assembly includes flexible, resilient, circumferential C-shaped tabs connected to a circumferential edge of the first clamping element. The second clamping element is a rigid member which includes a V-shaped circumferential edge. The resilient, circumferential C-shaped tabs are capable of being deformed into two deformation states.

A first deformation state of the resilient, circumferential C-shaped tabs results upon moving the clamped portion of the sock wall and the V-shaped circumferential edge past the resilient, circumferential C-shaped tabs by camming action of the V-shaped circumferential edge on the resilient, circumferential C-shaped tabs, as the second clamping element is being installed in the first clamping element.

A second deformation state of the resilient, circumferential C-shaped tabs results after the V-shaped circumferential edge has moved past the resilient, circumferential C-shaped tabs and is locked into the first clamping element by the resilient, circumferential C-shaped tabs. Whereby the sock clamp assembly is clamped onto the portion of the sock wall that is clamped between the resilient, circumferential C-shaped tabs and the V-shaped circumferential edge.

A plurality of pairs of first clamping elements may be retained on a first common support. A plurality of pairs of second clamping elements may be retained on a second common support. The pairs of first clamping elements bear pairs of similar indicia. The plurality of pairs of first clamping elements, the first common support, and the indicia born by the first clamping elements may be a unitary, plastic molded structure made by injection molding.

The above brief description sets forth rather broadly the more important features of the present invention in order that the detailed description thereof that follows may be better understood, and in order that the present contributions to the art may be better appreciated. There are, of course, additional features of the invention that will be described hereinafter and which will be for the subject matter of the claims appended hereto.

In this respect, before explaining at least three preferred embodiments of the invention in detail, it is understood that the invention is not limited in its application to the details of the construction and to the arrangements of the components set forth in the following description or illustrated in the drawings. The invention is capable of other embodiments and of being practiced and carried out in various ways. Also, it is to be understood, that the phraseology and terminology employed herein are for the purpose of description and should not be regarded as limiting.

As such, those skilled in the art will appreciate that the conception, upon which disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

Further, the purpose of the foregoing Abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. Accordingly, the Abstract is neither intended to define the invention or the application, which only is measured by the claims, nor is it intended to be limiting as to the scope of the invention in any way.

It is therefore an object of the present invention to provide a new and improved sock pairing apparatus which has all of the advantages of the prior art and none of tile disadvantages.

It is another object of the present invention to provide a new and improved sock pairing apparatus which may be easily and efficiently manufactured and marketed.

It is a further object of tile present invention to provide a new and improved sock pairing apparatus which is of durable and reliable construction.

An even further object of the present invention is to provide a new and improved sock pairing apparatus which is susceptible of a low cost of manufacture with regard to both materials and labor, and which accordingly is then susceptible of low prices of sale to the consuming public, thereby making such sock pairing apparatus available to the buying public.

Still yet a further object of the present invention is to provide a new and improved sock pairing apparatus that assists in proper matching of intermingled socks no matter what form of light the intermingled socks are viewed in.

Still another object of the present invention is to provide a new and improved sock pairing apparatus that enables identification of pairs of socks from an intermingled pile which does not use sewn in threads.

Yet another object of the present invention is to provide a new and improved sock pairing apparatus that enables identification of pairs of socks from an intermingled pile without using heat activated labels.

Even another object of the present invention is to provide a new and improved sock pairing apparatus that enables identification of pairs of socks from an intermingled pile without the need to know the skills of sewing.

Still a further object of the present invention is to provide a new and improved sock pairing apparatus which does not require the use of special materials for laundering that are removed after laundering and replaced for the next laundering.

Yet another object of the present invention is to provide a new and improved sock pairing apparatus that enables identification of pairs of socks from an intermingled pile without the disadvantages that occur from using a laundry marking pen.

These together with still other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and the above objects as well as objects other than those set forth above will become more apparent after a study of the following detailed description thereof. Such description makes reference to the annexed drawing wherein.

DESCRIPTION OF THE PREFERRED EMBODIMENT

Figure 1:
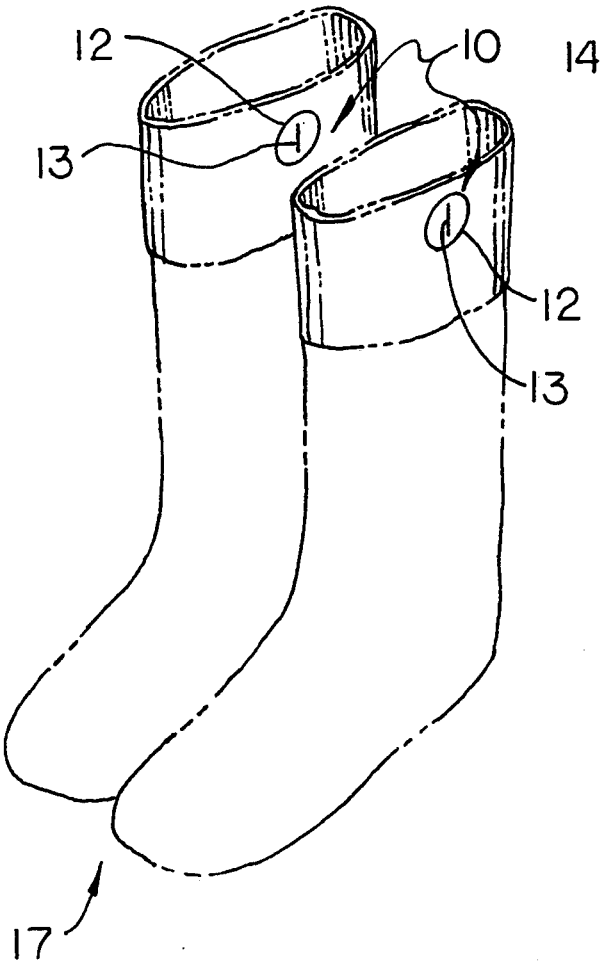
FIG. 1 is a perspective view showing a first preferred embodiment of the sock pairing apparatus of the invention installed on a pairs of socks.

With reference to the drawings, a new and improved sock pairing apparatus embodying the principles and concepts of the present invention will be described.

Turning initially to FIGS. 1–4, there is shown a first exemplary embodiment of the sock pairing apparatus of the invention generally designated by reference numeral 10.

The sock pairing apparatus 10 includes a pair of similar sock clamp assemblies 12 which include similar indicia 13. Each respective sock clamp assembly 12 is used with one sock 11 of a pair of socks 17. Each respective sock clamp assembly 12 includes a pair of first and second clamping elements for clamping the respective sock clamp assembly 12 onto a respective sock of the pair of socks 17. Each respective first clamping element 14 is placed on a respective sock against a first side 19 (e.g. the outside) of a sock wall 15. Each respective second clamping element 16 is placed against a second side 21 (e.g. the inside) of the respective sock wall 15 in registration with the respective first clamping element 14 and clamped thereto. Whereby a portion 22 of the sock wall 15 is clamped between the respective first clamping element 14 and the respective second clamping element 16; and whereby each respective similar sock clamp assembly 12 is attached to a respective sock in the pair of socks 17; and both socks in the pair of socks 17 bear similar indicia 13. Once the first clamping element 14 and the second clamping element 16 are clamped together with a portion 22 of the wall 15 of the sock therebetween, the respective sock clamp assembly 12 is permanently attached to the respective sock 11.

Figure 2:
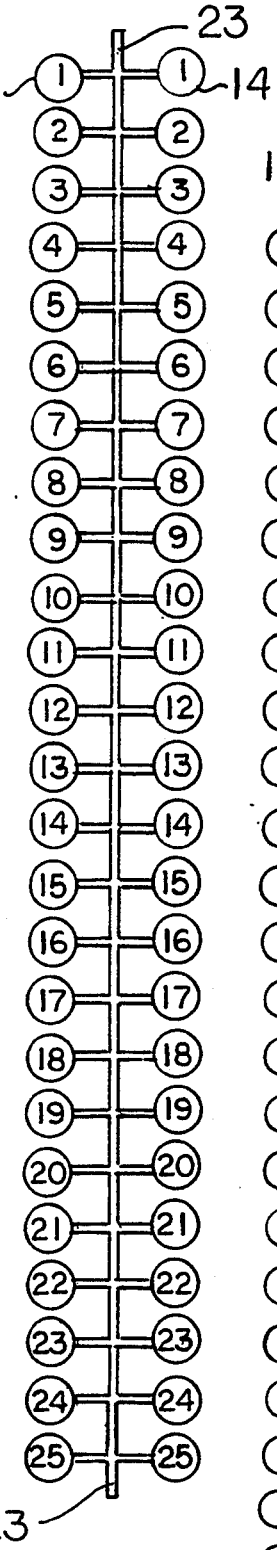
FIG. 2 is a side view of a plurality of pairs of first clamping elements retained on a first common support, the pairs of first clamping elements bearing pairs of similar indicia.

As shown in FIG. 2, twenty-five consecutively numbered pairs of first clamping elements 14 are retained on a first common support 23 that has the appearance of a tree with branches. The pairs of first clamping elements 14 bear pairs of similar indicia 13. As shown in FIG. 2, the plurality of pairs of first clamping elements 14, the first common support 23, and the indicia 13 born by the first clamping elements 14 are a unitary, plastic molded structure made by injection molding. The plastic employed can be nylon.

Figure 3:
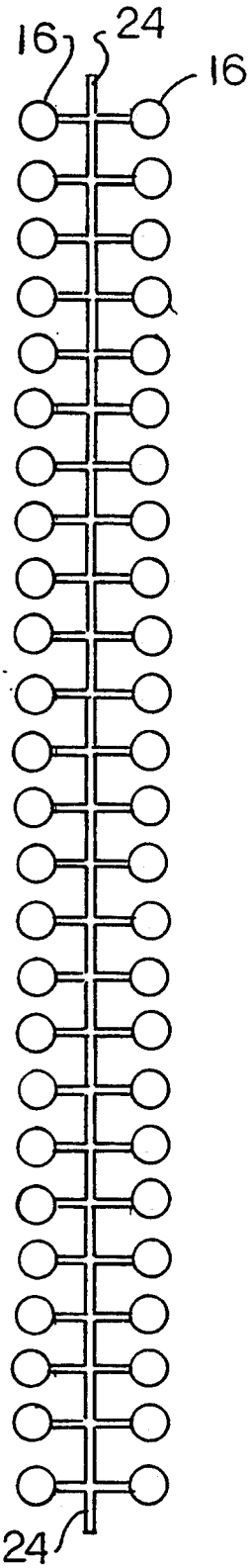
FIG. 3 is a side view of a plurality of pairs of second clamping elements are retained on a second common support.

As shown in FIG. 3, twenty-five pairs of second clamping elements 16 are retained on a second common support 24 that has the appearance of a tree with branches. The plurality of pairs of second clamping elements 16 and the second common support 24 are a unitary, plastic molded structure made by injection molding.

As shown in FIGS. 4–10, the first clamping element 14 and the second clamping element 16 are complementary.

As shown in FIG. 4–7, the first clamping element 14 is a rigid member that includes locking assembly 18 for locking the second clamping element 16 thereto. The second clamping element 16 is a flexible, resilient member that is capable of being deformed into two deformation states. A first deformation state of the second clamping element 16 occurs upon moving the clamped portion 22 of the sock wall 15 past the locking assembly 18 and upon moving past the locking assembly 18 as the second clamping element 16 is being installed in the first clamping element 14.

A second deformation state of the second clamping element 16 is assumed after the second clamping element 16 has passed by the locking assembly 18 and is locked into the first clamping element 14 by the locking assembly 18. In the second deformation state of the second clamping element 16, the sock clamp assembly 12 is permanently clamped onto the portion 22 of the sock wall 15 that is clamped between the first clamping element 14 and the second clamping element 16.

Figure 4:
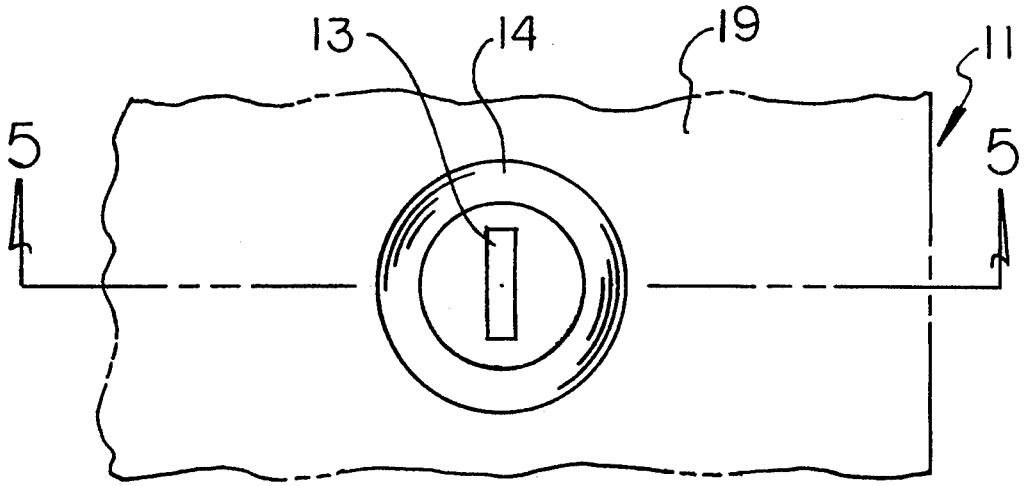
FIG. 4 is a top enlarged view of one of the sock clamp assemblies bearing indicia "1" of FIGS. 2 and 3 installed on a sock, wherein the locking assembly on the first clamping element includes a circumferential, C-shaped flange, and the second clamping element includes a flexible, resilient disk element.
Figure 5:
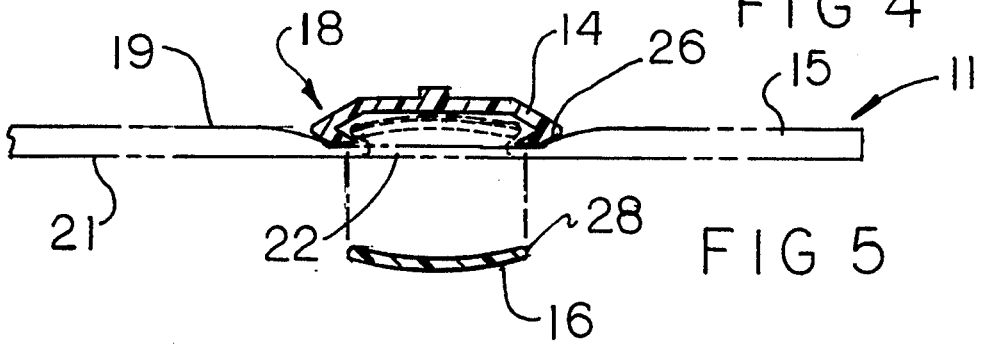
FIG. 5 is a cross-sectional view of the sock clamp assembly shown in FIG. 4 taken along the line 5—5 of FIG. 4.
Figure 6:
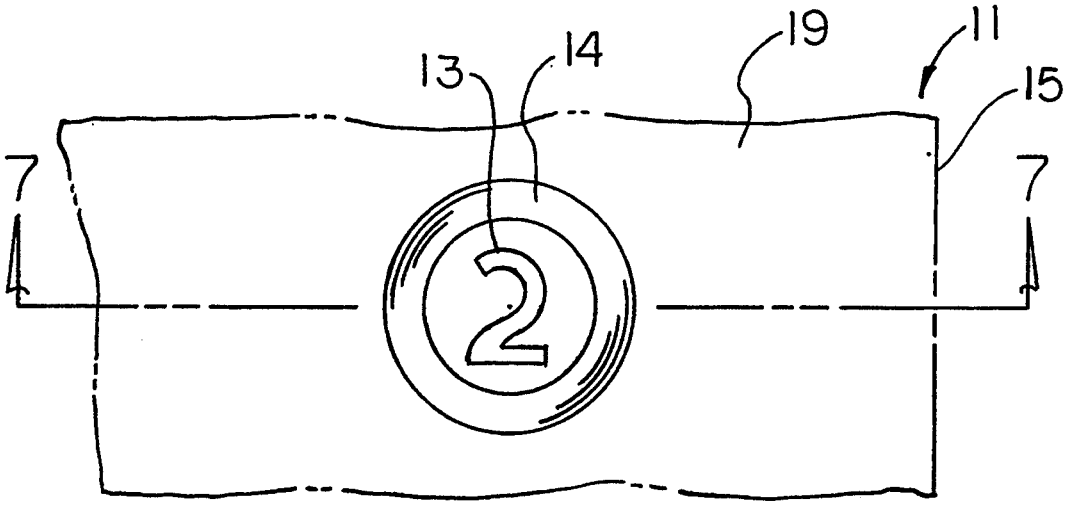
FIG. 6 is a top enlarged view of a second preferred embodiment of one sock clamp assembly bearing indicia "2" installed on a sock, wherein the locking assembly on the first clamping element includes a centrally located, C-shaped flange, and the second clamping element includes a flexible, resilient, snap-on disk element which includes a complementary, C-shaped well that is complementary to the centrally located, C-shaped flange.

As shown in FIG. 4, the locking assembly 18 on the first clamping element 14 includes a circumferential, C-shaped flange 26. The second clamping element 16 is a flexible, resilient disk element 16 which includes a circumferential edge 28 which pushes a portion of the sock wall 15 into the circumferential, C-shaped flange 26 and fits into the circumferential, C-shaped flange 26 when a sock clamp assembly 12 installed on the sock 11.

Figure 7:
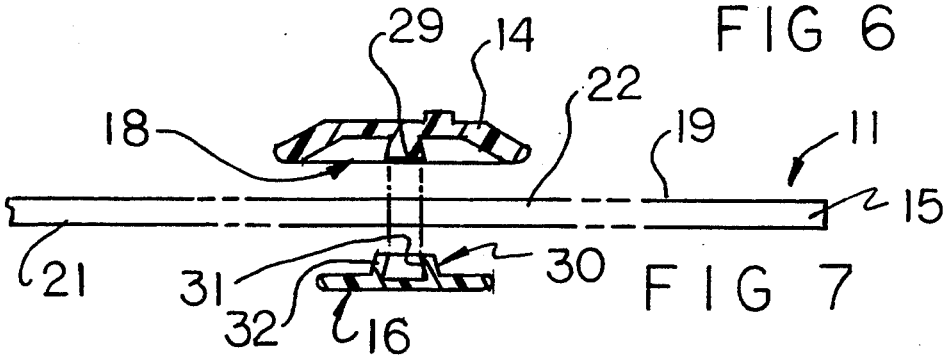
FIG. 7 is a cross-sectional view of the sock clamp assembly shown in FIG. 6 taken along the line 7—7 of FIG. 6.

As shown in FIG. 7, the locking assembly 18 on the first clamping element 14 includes a centrally located, C-shaped flange 29. The second clamping element 16 includes a flexible, resilient, snap-on disk element 30 which includes a complementary, C-shaped well 31 that is complementary to the centrally located, C-shaped flange 29. In operation, walls 32 of the complementary, C-shaped well 31 push a portion of the sock wall 15 onto the centrally located, C-shaped flange 29 and fit onto the centrally located, C-shaped flange 29 when a sock clamp assembly is 12 installed on the sock 11.

Figure 8:
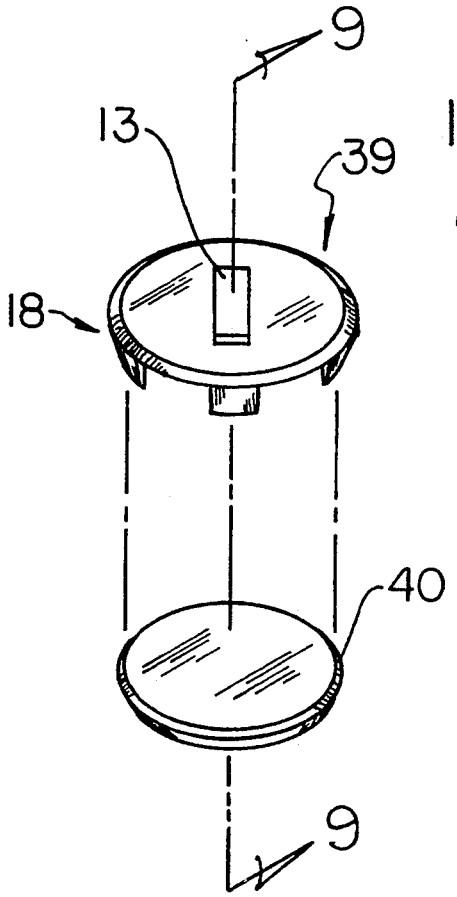
FIG. 8 is an exploded perspective view of a third preferred embodiment of one sock clamp assembly bearing indicia "1", wherein the first clamping element includes resilient, circumferential C-shaped tabs, and the second clamping element includes a V-shaped circumferential edge 40.
Figure 9:
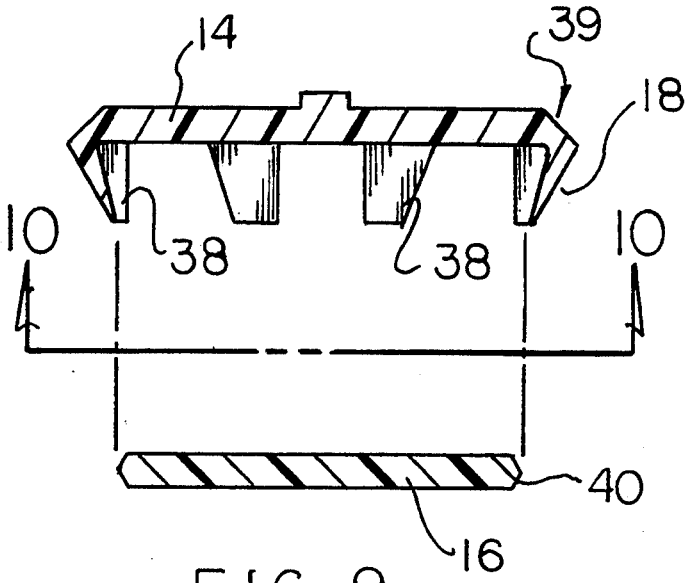
FIG. 9 is an enlarged exploded side view of the embodiment of the invention shown in FIG. 8.
Figure 10:
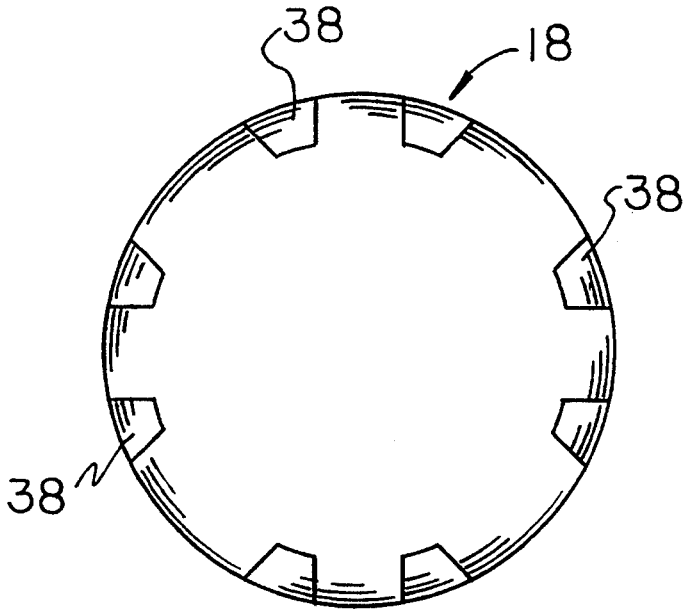
FIG. 10 is a bottom view of the first clamping element shown in FIG. 9 taken along the line 10—10 thereof.

As shown in FIGS. 8–10, the first clamping element 14 and the second clamping element 16 are complementary. In addition, the first clamping element 14 includes a locking assembly 18 for locking the second clamping element 16 thereto. The locking assembly 18 includes flexible, resilient, circumferential C-shaped tabs 38 connected to a circumferential edge 39 of the first clamping element 14. The second clamping element 16 is a rigid member which includes a V-shaped circumferential edge 40.

The resilient, circumferential C-shaped tabs 38 are capable of being deformed into two deformation states. A first deformation state of the resilient, circumferential C-shaped tabs 38 results upon moving the clamped portion 22 of the sock wall 15 and the V-shaped circumferential edge 40 past the resilient, circumferential C-shaped tabs 38 by a camming action of the V-shaped circumferential edge 40 on the resilient, circumferential C-shaped tabs 38, as the second clamping element 16 is being installed in the first clamping element 14.

A second deformation state of the resilient, circumferential C-shaped tabs 38 results after the V-shaped circumferential edge 40 has moved past the resilient, circumferential C-shaped tabs 38 and is locked into the first clamping element 14 by the resilient, circumferential C-shaped tabs 38. Whereby the sock clamp assembly 12 is permanently clamped onto the portion 22 of the sock wall 15 that is clamped between the resilient, circumferential C-shaped tabs 38 and the V-shaped circumferential edge 40.

As shown in FIGS. 4–9, the indicia 13 are molded onto the first clamping elements 14.

The components of the sock pairing apparatus of the invention can be made from inexpensive and durable plastic molded materials.

It is apparent from the above that the present invention accomplishes all of the objects set forth by providing a new and improved sock pairing apparatus that is low in cost, relatively simple in design and operation, and which may advantageously be used in proper matching of pairs of socks from a pile of intermingled socks no matter what form of light the intermingled socks are viewed in. Also, the invention enables identification of pairs of socks from an intermingled pile without using sewn-in threads. With the invention, identification of pairs of socks from an intermingled pile is enabled without using heat activated labels. With the invention, identification of pairs of socks from an intermingled pile is provided without the need to know the skills of sewing. With the invention, the use of special materials for laundering that are removed after laundering and that are replaced for the next laundering are not required. With the invention, identification of pairs of socks from an intermingled pile is carried out without the disadvantages of using a laundry marking pen.

With respect to the above description, it should be realized that the optimum dimensional relationships for the parts of the invention, to include variations in size, form function and manner of operation, assembly and use, are deemed readily apparent and obvious to those skilled in the art, and therefore, all relationships equivalent to those illustrated in the drawings and described in the specification are intended to be encompassed only by the scope of appended claims.

While the present invention has been shown in the drawings and fully described above with particularity and detail in connection with what is presently deemed to be the most practical and preferred embodiments of the invention, it will be apparent to those of ordinary skill in the art that many modifications thereof may be made without departing from the principles and concepts set forth herein. Hence, the proper scope of the present invention should be determined only by the broadest interpretation of the appended claims so as to encompass all such modifications and equivalents.

What is claimed as being new and desired to be protected by Letters Patent of the United States is as follows:

1. A new and improved sock pairing apparatus, comprising:

a plurality of pairs of sock clamp assemblies, each sock clamp assembly adapted to clamp onto a sock and each pair of sock clamp assemblies adapted to clamp onto a pair of socks, wherein each sock clamp assembly includes a first clamping element and a second clamping element, wherein one sock of a pair of socks is capable of being clamped between one first clamping element and one second clamping element, wherein another sock of the pair of socks is capable of being clamped between another first clamping element and another second clamping element, wherein a plurality of pairs of first clamping elements are retained on a first common support, wherein a plurality of pairs of second clamping elements are retained on a second common support, wherein said respective pairs of first clamping elements bear respective pairs of similar indicia, wherein said similar indicia are numerical indicia, and wherein said pairs of first clamping elements bearing similar numerical indicia are arrayed on said first common support in a numerical sequence, wherein said locking assembly means on said first clamping element include a circumferential, C-shaped flange, and said second clamping element includes a flexible, resilient disk element which includes a circumferential edge which pushes a portion of the sock wall into said circumferential, C-shaped flange and fits into said circumferential, C-shaped flange when a sock clamp assembly is installed on the sock.

2. The apparatus described in claim 1 wherein:

said first clamping elements and said second clamping elements are complementary, said first clamping elements are rigid members that include locking assembly means for locking said second clamping elements thereto, said second clamping elements are flexible, resilient members, wherein each second clamping element is capable of being deformed into two deformation states, a first deformation state of said second clamping element upon moving the clamped portion of a sock wall past said locking assembly means and upon passing by said locking assembly means as said second clamping element is being installed in a first clamping element, and a second deformation state of said second clamping element that said second clamping element assumes after said second clamping element has moved past said locking assembly means and is locked into said first clamping element by said locking assembly means, whereby said sock clamp assembly is clamped onto said portion of the sock wall that is clamped between said first clamping element and said second clamping element.

3. The apparatus described in claim 2 wherein:

said locking assembly means on said first clamping element include a centrally located, C-shaped flange, and said second clamping element includes a flexible, resilient, snap-on disk element which includes a complementary, C-shaped well that is complementary to said centrally located, C-shaped flange, wherein walls of said complementary, C-shaped well push a portion of the sock wall onto said centrally located, C-shaped flange and fits onto said centrally located, C-shaped flange when a sock clamp assembly is installed on the sock.

4. The apparatus described in claim 1 wherein:

said first clamping element and said second clamping element are complementary, said first clamping element includes locking assembly means for locking said second clamping element thereto, said locking assembly means include flexible, resilient, circumferential C-shaped tabs connected to a circumferential edge of said first clamping element, said second clamping element is a rigid member which includes a V-shaped circumferential edge, said resilient, circumferential C-shaped tabs are capable of being deformed into two deformation states, a first deformation state of said resilient, circumferential C-shaped tabs results upon moving the clamped portion of the sock wall and said V-shaped circumferential edge past said resilient, circumferential C-shaped tabs by camming action of said V-shaped circumferential edge on said resilient, circumferential C-shaped tabs, as said second clamping element is being installed in said first clamping element, and a second deformation state of said resilient, circumferential C-shaped tabs results after said V-shaped circumferential edge has moved past said resilient, circumferential C-shaped tabs and is locked into said first clamping element by said resilient, circumferential C-shaped tabs, whereby said sock clamp assembly is clamped onto said portion of the sock wall that is clamped between said resilient, circumferential C-shaped tabs and said V-shaped circumferential edge.

5. The apparatus described in claim 1 wherein said indicia are molded onto said first clamping elements.

6. The apparatus described in claim 1 wherein said plurality of pairs of first clamping elements, said first common support, and said indicia born by said first clamping elements are a unitary, plastic molded structure.

7. The apparatus described in claim 8 wherein said unitary, plastic molded structure is made by injection molding.

8. The apparatus described in claim 1 wherein said plurality of pairs of second clamping elements and said second common support are a unitary, plastic molded structure.

9. The apparatus described in claim 10 wherein said unitary, plastic molded structure is made by injection molding.

* * * * *